US005322025A

United States Patent [19]

Sherman et al.

[11] Patent Number: 5,322,025

[45] Date of Patent: Jun. 21, 1994

[54] ADJUSTABLE DUAL WORKSURFACE SUPPORT

[75] Inventors: Patrick J. Sherman; Dale A. Johnson, both of Wyoming; Robert B. Lubinskas, Hastings; Dennis D. Roach, Walker; George J. Simons, Jr.; Lynn S. Smith, both of Grand Rapids; Bradley D. Youngs, Kentwood; Lyle F. Homrich, Jenison, all of Mich.

[73] Assignee: Steelcase Inc., Grand Rapids, Mich.

[21] Appl. No.: 889,829

[22] Filed: May 29, 1992

[51] Int. Cl.[5] ..... A47B 9/00

[52] U.S. Cl. ..... 108/147; 108/84

[58] Field of Search ..... 108/106, 144, 147, 20, 108/84, 96

[56] References Cited

U.S. PATENT DOCUMENTS

| | | | |
|---|---|---|---|
| 2,532,341 | 12/1950 | Sloane | 60/97 |
| 2,831,746 | 4/1958 | Hartnett | 108/147 |
| 2,838,844 | 6/1958 | Sackett | 33/209 |
| 2,872,200 | 2/1959 | Kroll | 280/6 |
| 3,030,930 | 4/1962 | Gratzmuller | 121/40 |
| 3,080,835 | 3/1963 | Guglielmi | 108/116 |
| 3,129,825 | 4/1964 | Lamb | 108/147 |
| 3,269,685 | 8/1966 | Wallace | 248/346 |
| 3,415,586 | 12/1968 | Hammond | 312/312 |
| 3,476,016 | 11/1969 | Dixon et al. | 91/411 |
| 3,516,513 | 6/1970 | Robertson et al. | 182/19 |
| 3,578,278 | 5/1971 | Pickering | 248/20 |
| 3,636,708 | 1/1972 | Karman | 60/52 R |
| 3,724,210 | 4/1973 | Kobashi et al. | 60/54.6 |
| 3,731,470 | 5/1973 | Cornish et al. | 56/10.4 |
| 3,732,783 | 5/1973 | Emenaker | 91/44 |
| 3,744,373 | 7/1973 | Leijon | 91/178 |
| 3,796,282 | 3/1974 | Denier et al. | 182/141 |
| 3,820,176 | 6/1974 | Feiertag | 5/63 |
| 3,832,852 | 9/1974 | Schmucker | 60/546 |
| 3,853,075 | 8/1974 | Burch | 108/136 |
| 3,875,872 | 4/1975 | Kayner | 108/1 |
| 3,945,457 | 3/1976 | Olsen | 180/79.2 R |
| 3,953,040 | 3/1976 | Unruh et al. | 280/6 |

(List continued on next page.)

FOREIGN PATENT DOCUMENTS

| | | | |
|---|---|---|---|
| 515132 | 11/1952 | Belgium . | |
| 1429534 | 1/1969 | Fed. Rep. of Germany . | |
| 2922945 | 12/1980 | Fed. Rep. of Germany . | |
| 3314388A1 | 5/1984 | Fed. Rep. of Germany . | |
| 1490706 | 6/1967 | France | 108/147 |
| 449044 | 4/1987 | Sweden . | |
| 163833 | 11/1933 | Switzerland . | |
| 2081080 | 2/1982 | United Kingdom . | |
| 2195886 | 4/1988 | United Kingdom | 108/147 |

*Primary Examiner*—Kenneth J. Dorner
*Assistant Examiner*—Gerald A. Anderson
*Attorney, Agent, or Firm*—Price, Heneveld, Cooper, DeWitt & Litton

[57] ABSTRACT

An adjustable dual worksurface support is provided for electronic data processing equipment and the like, and comprises a freestanding pedestal, and a generally U-shaped first worksurface having a front surface shaped to support a keyboard thereon, and two side surfaces extending rearwardly from opposite sides thereon to define a central open area. A second worksurface is provided to support a display thereon, and has a plan shape similar to that of the central open area of the keyboard worksurface for close reception therein. The keyboard worksurface is vertically adjustable with respect to the floor, preferably between sitting and standing positions, and the display worksurface is vertically adjustable with respect to the keyboard worksurface, preferably to positions both above and below the same to accommodate various users and tasks.

19 Claims, 3 Drawing Sheets

U.S. PATENT DOCUMENTS

| | | | |
|---|---|---|---|
| 4,140,044 | 2/1979 | Biller et al. | 92/5 |
| 4,154,173 | 4/1979 | Chesnut | 108/6 |
| 4,164,122 | 8/1979 | Ward | 56/11.9 |
| 4,192,222 | 3/1980 | Dits | 91/517 |
| 4,192,225 | 3/1980 | Moyer | 92/169 |
| 4,241,641 | 12/1980 | Reinert | 91/189 |
| 4,275,795 | 6/1981 | Beimgraben et al. | 175/26 |
| 4,354,688 | 10/1982 | Swanson | 280/43.23 |
| 4,373,334 | 2/1983 | Carlander | 60/594 |
| 4,374,497 | 2/1983 | Harmand | 108/4 |
| 4,381,714 | 5/1983 | Henneberg et al. | 108/147 |
| 4,409,884 | 10/1983 | Boehringer | 91/17 |
| 4,477,045 | 10/1984 | Karasawa et al. | 248/1 |
| 4,516,478 | 4/1985 | Connelly | 92/137 |
| 4,535,788 | 8/1985 | Rowland-Hill et al. | 130/27 |
| 4,548,214 | 10/1985 | Sheehan et al. | 130/27 |
| 4,550,666 | 11/1985 | Svoboda | 108/96 |
| 4,557,276 | 12/1985 | Hyman et al. | 130/27 |
| 4,567,727 | 2/1986 | Grams | 60/546 |
| 4,598,955 | 7/1986 | Belart et al. | 303/114 |
| 4,604,955 | 8/1986 | Fleischer et al. | 108/147 |
| 4,632,349 | 12/1986 | Anstey | 248/281.1 |
| 4,637,322 | 1/1987 | Hampshire et al. | 108/102 |
| 4,651,652 | 3/1987 | Wyckoff | 108/144 |
| 4,655,031 | 4/1987 | Kucera | 56/11.9 |
| 4,681,021 | 7/1987 | Heinemann et al. | 91/178 |
| 4,711,184 | 12/1987 | Wallin et al. | 108/144 |
| 4,729,283 | 3/1988 | Hillier | 91/189 |
| 4,754,713 | 7/1988 | Chatenay | 108/144 |
| 4,756,496 | 7/1988 | Hosan et al. | 248/161 |
| 4,781,126 | 11/1988 | Lochridge | 108/6 |
| 4,825,655 | 5/1989 | Buchl et al. | 60/546 |
| 4,860,646 | 8/1989 | Spiers | 100/48 |
| 4,894,600 | 1/1990 | Kearney | 318/649 |
| 4,953,639 | 9/1990 | Hamner et al. | 175/203 |
| 4,976,336 | 12/1990 | Curran | 187/8.5 |
| 4,981,085 | 1/1991 | Watt | 108/147 |

OTHER PUBLICATIONS

"Cessna Model 51000 Wyr-Loc Cylinders" brochure, Hutchinson, Kansas, 15 pages, Mar. 1, 1984.

ADJUSTABLE DUAL WORKSURFACE SUPPORT

CROSS REFERENCES TO RELATED APPLICATIONS

The present application is related to commonly assigned, co-pending U.S. patent application Ser. No. 774,455 filed Oct. 10, 1991, entitled ADJUSTABLE DUAL WORKSURFACE SUPPORT, which is hereby incorporated by reference.

BACKGROUND OF THE INVENTION

The present invention relates to furnishings for electronic data processing equipment and the like, and in particular, to an adjustable dual worksurface support therefor.

Electronic data processing equipment such as personal computers, communications monitors, workstation terminals, etc., have become an important part of modern offices. Many different types of specialized furniture have already been developed to support such equipment. However, heretofore, computer furniture has typically been either quite massive in construction, with associated high costs and maintenance problems, or relatively lightweight, with limited adjustability, stability, and durability.

SUMMARY OF THE INVENTION

One aspect of the present invention is an adjustable dual worksurface support for electronic data processing equipment, generally of the type having a keyboard and a display. The support includes a freestanding pedestal, and a first worksurface having a generally U-shaped top plan configuration, comprising a front surface shaped to support a keyboard thereon, and first and second side surfaces extending rearwardly from opposite sides of the front surface to define therebetween a central open area with a predetermined plan configuration. A second worksurface is provided having a plan shape similar to the predetermined plan configuration of the central open area of the first worksurface for close reception therein, and is shaped to support a display thereon. The second worksurface is supported on the first worksurface, and is vertically adjustable with respect to the first worksurface to accommodate various users and tasks.

Another aspect of the present invention is a dual worksurface support for electronic data processing equipment and the like of the type having a keyboard and display. The support includes a freestanding pedestal adapted to be supported on a floor surface. A first worksurface is shaped to support a keyboard thereon, and is movably supported on the pedestal for vertical adjustment above the floor surface between sitting and standing positions. A second worksurface is shaped to support a display thereon, and is supported on the first worksurface for vertical movement therewith, and is vertically adjustable with respect to the first worksurface between positions both above and below the first worksurface to accommodate various users and tasks.

Yet another aspect of the present invention is a vertically adjustable support for electronic data processing equipment and the like. The support comprises a worksurface shaped to support office-type equipment thereon. A pedestal having an upper portion thereof is connected with the worksurface, and includes a lower portion adapted to be supported on a floor surface. The pedestal has at least one telescoping leg for vertically adjusting the worksurface above the floor surface. The telescoping leg includes a longitudinally extensible linear actuator having opposite ends thereof connected with the upper and lower portions of the pedestal. A first guide assembly is positioned rearwardly of the linear actuator in fore-to-aft alignment with the same, and includes a pair of vertically oriented telescoping tubular members connected with the upper and lower portions of the pedestal for ensuring smooth vertical extension and retraction of the pedestal. A second guide tube assembly is positioned forwardly of the linear actuator in fore-to-aft alignment with the linear actuator and the first guide tube assembly, and includes a pair of vertically oriented telescoping tubular members connected with the upper and lower portions of the pedestal for ensuring smooth vertical extension and retraction, such that the linear actuator evenly raises and lowers the worksurface.

Yet another aspect of the present invention is a vertically adjustable support for electronic data processing equipment and the like. The support includes a worksurface shaped to support office-type equipment thereon. A freestanding pedestal has an upper portion thereof connected with the worksurface, and a lower portion thereof adapted to be supported on a floor surface. The pedestal has a pair of telescoping legs depending from opposite sides of the worksurface for vertically adjusting the worksurface above the floor surface. The telescoping legs include at least one longitudinally extensible hydraulic cylinder having opposite ends thereof connected with the upper and lower portions of the pedestal. A hydraulic pressure generator unit is provided for selectively activating the hydraulic cylinder. An elongate utility raceway extends between the telescoping legs of the support along lower portions thereof, and houses the hydraulic pressure generator unit therein.

The principal objects of the present invention are to provide a worksurface support for electronic data processing equipment and the like, which is stable, relatively lightweight, and readily adjustable to many different convenient heights. The dual worksurface arrangement permits two different pieces of electronic data processing equipment to be independently adjusted to more closely suit the needs of a variety of different users and tasks. A unique, U-shaped keyboard worksurface arrangement is preferably vertically adjustable between sitting and standing positions. A display worksurface is positioned within the central open area of the keyboard worksurface, and is preferably vertically adjustable independently of the keyboard worksurface to positions both above and below the same. Hydraulic cylinders and telescoping guide tube assemblies are provided to achieve smooth vertical translation of both the keyboard and display worksurfaces in infinitely small increments. A utility raceway extends between the opposite legs of the freestanding pedestal to neatly and compactly house the hydraulic equipment therein a spaced apart distance from the electronic equipment to avoid interference with the same. The dual worksurface support has a rather uncomplicated design, with associated reduced manufacturing costs, and can be easily operated by all types of personnel. The dual worksurface support is efficient in use, capable of long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
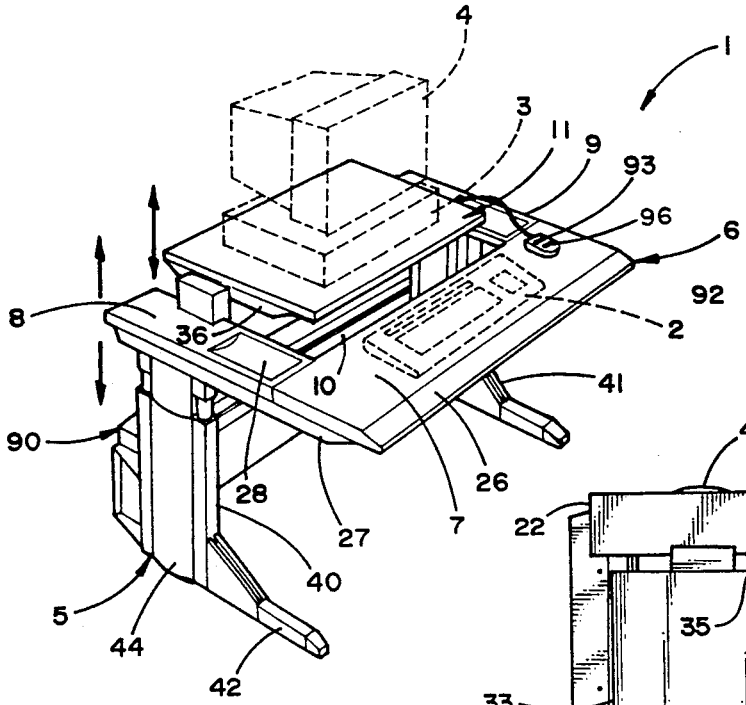
FIG. 1 is a perspective view of an adjustable dual worksurface support embodying the present invention.

For purposes of description herein, the terms "upper", "lower", "right", "left", "rear", "front", "vertical", "horizontal", and derivatives thereof shall relate to the invention as oriented in FIG. 1, with a user facing the front of the dual worksurface support. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
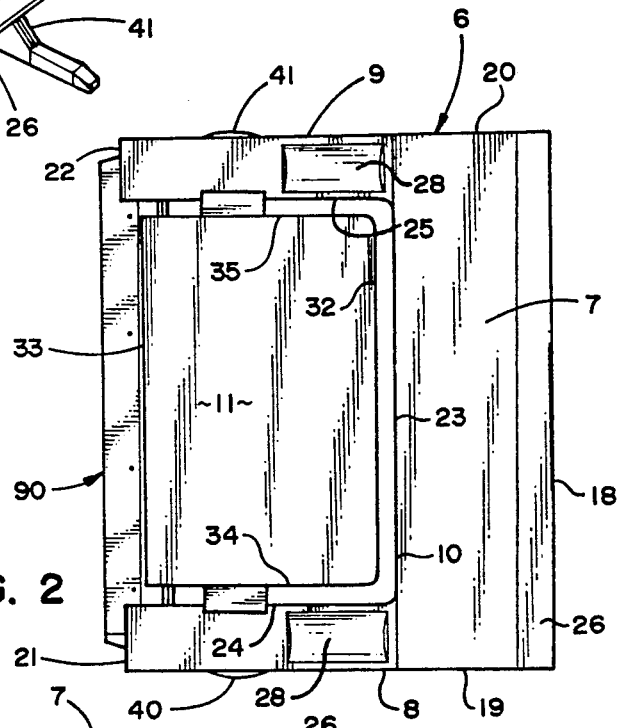
FIG. 2 is a top plan view of the dual worksurface support.

The reference numeral 1 (FIG. 1) generally designates an adjustable dual worksurface support embodying the present invention. Dual worksurface support 1 is particularly adapted for use with electronic data processing equipment and the like, such as the illustrated keyboard 2 processor 3 and display 4. Dual worksurface support 1 includes a freestanding pedestal 5, and a generally U-shaped first worksurface 6, having a front surface 7 shaped to support the keyboard 2 thereon, and two side surfaces 8 and 9 extending rearwardly from opposite sides of front surface 7 to define a central open area 10. A second worksurface 11 is provided to support the processor 3 and display 4 thereon, and has a plan shape similar to that of the central open area 10 of keyboard worksurface 6 for close reception therein, as best shown in FIG. 2. The keyboard worksurface 6 is vertically adjustable with respect to the floor, preferably between sitting and standing positions, and the display worksurface 11 is vertically adjustable with respect to the keyboard worksurface 6, preferably between positions both above and below the same, so as to accommodate various users and tasks.

The illustrated keyboard worksurface 6 (FIGS. 1-3) has a generally U-shaped top plan configuration, comprising a front edge 18, opposite side edges 19 and 20, and truncated rear edges 21 and 22. The central open area 10 of keyboard worksurface 6 has a generally rectangular plan configuration, as does the balance of keyboard worksurface 6, and is defined by interior edges 23-25. A forward portion of keyboard worksurface 6 includes an inclined or beveled wrist support surface 26, which is positioned between front surface 7 and front edge 18. In the illustrated keyboard worksurface 6, each of the side surfaces 8 and 9 includes a storage recess 28 therein, which is shaped to receive pencils, pens, paper clips, and the like therein. A pair of cantilever brackets 27 are attached to the lower surface of keyboard worksurface 6, and extend along opposite sides thereof below side surfaces 8 and 9 to facilitate attachment to pedestal 5, as described in greater detail hereinafter.

The illustrated display worksurface 11 (FIGS. 1-3) has a generally rectangular plan configuration that is similar to that of the central open area 10 of keyboard worksurface 6, and is defined by a front edge 32, a rear edge 33, and opposite side edges 34 and 35. Display worksurface 11 is sized to be closely received within the central open area 10 of keyboard worksurface 6, and reciprocates vertically therethrough. A pair of cantilever brackets 36 are fastened to the lower surface of display worksurface 11, and extend along side edges 34 and 35 for adjustably mounting display worksurface 11 on keyboard worksurface 6 in the manner described more fully below.

Figure 3:
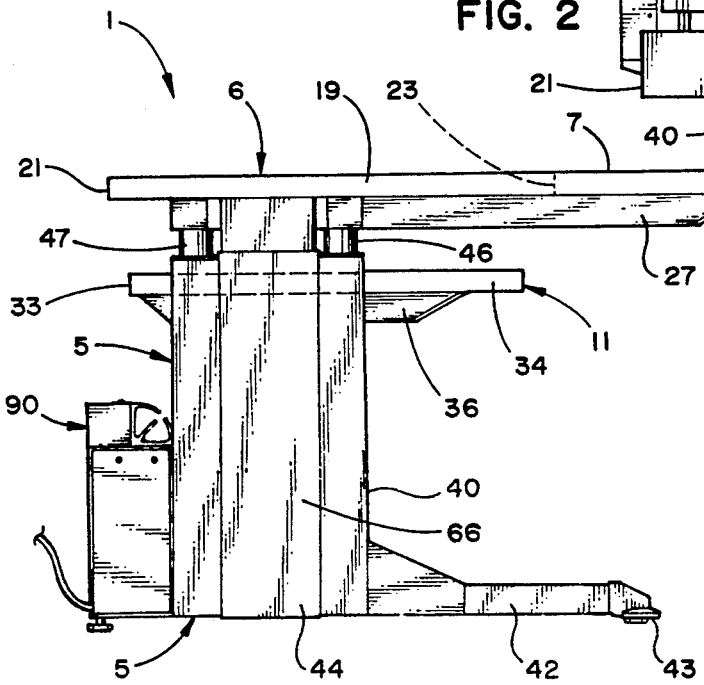
FIG. 3 is a side elevational view of the dual worksurface support.
Figure 4:
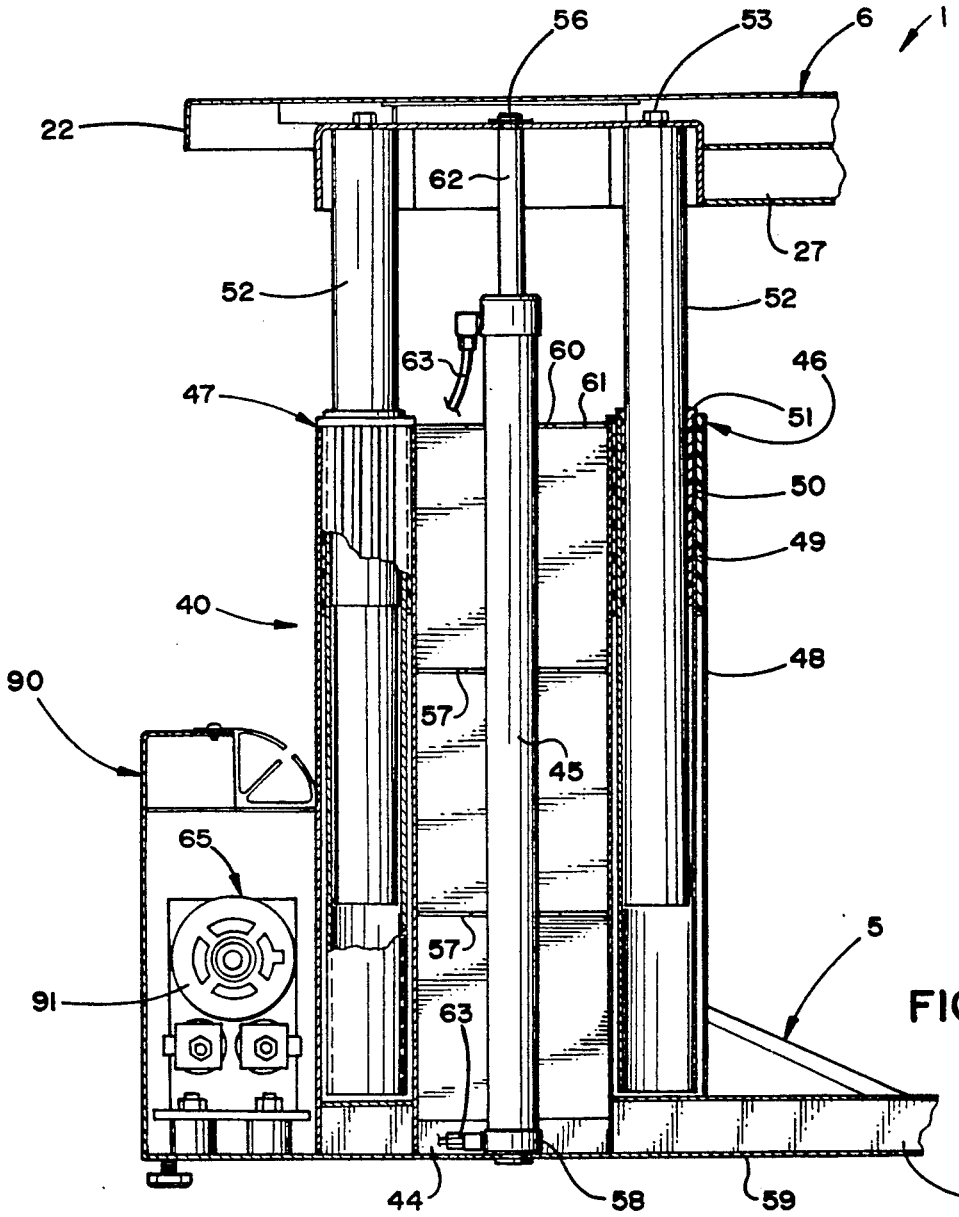
FIG. 4 is an enlarged, fragmentary, side elevational view of the dual worksurface support, wherein portions thereof have been broken away to reveal internal construction.

Pedestal 5 (FIGS. 1-3) is a freestanding type of support, and includes a pair of telescoping leg assemblies 40 and 41 positioned at opposite sides of keyboard worksurface 6, directly below cantilever brackets 27. The right and left hand leg assemblies 40 and 41 are substantially identical in construction, and each has a generally L-shaped side elevational configuration. The upper portion of each leg assembly 40 and 41 is connected with a rearward portion of keyboard worksurface 6, so as to support the same in a cantilevered fashion above the floor surface, thereby providing adequate kneespace for a seated user. With reference to FIG. 3, each of the leg assemblies 40 and 41 includes a forwardly extending foot 42 with an adjustable glide 43 at the forward end thereof, and a stationary housing or base 44 upstanding from the rearward end thereof. Base 44 houses a hydraulic cylinder 45 (FIGS. 4 and 5), and two guide tube assemblies 46 and 47, which are positioned on opposite sides of hydraulic cylinder 45, in fore-to-aft alignment with the same. Each of the guide tube assemblies 46 and 47 has a three-piece telescoping design, comprising a cylindrically shaped, stationary outer tube 48, which is fixedly mounted in base 44. A primary, sleeve-shaped guide bearing 49 is positioned in the upper end of outer tube 48. A cylindrically shaped intermediate tube 50 is telescopingly received within the guide bearing 49 of outer tube 48, and includes a sleeve-shaped, intermediate guide bearing 51 positioned at the upper end thereof. An inner tube 52 is telescopingly received within intermediate guide bearing 51, and has its upper end fixedly attached to an associated one of the cantilever brackets 27 by a fastener 53.

Hydraulic cylinder 45 (FIGS. 4 and 5) has its housing or lower end 58 mounted to a bottom plate portion 59 of base 44, and extends upwardly therefrom through cross brace plates 57, and out through an aperture 60 in an upper plate 61 portion of base 44. The rod or upper end 62 of hydraulic cylinder 45 is attached to an associated one of the cantilever brackets 27 by a fastener arrangement 56. Hence, hydraulic cylinder 45 is positioned directly inbetween guide tube assemblies 46 and 47, in fore-to-aft alignment with the same. The simultaneous extension and retraction of both hydraulic cylinders 45 telescopingly extends and retracts tubes 50 and 52 of each of the guide tube assemblies 46 and 47, thereby smoothly and evenly raising and lowering the vertical position of associated keyboard worksurface 6, as well as display worksurface 11. Hydraulic lines 63 communicate pressurized hydraulic fluid to hydraulic cylinder 45 from a hydraulic pressure generating unit 65, which is described in greater detail below. A removable cover plate 66 (FIG. 5) extends between adjacent outer tubes 48 to enclose the exterior side of the associated leg assemblies 40 and 41, while permitting access to hydraulic cylinders 45 for repair and/or replacement. Leg assemblies 40 and 41 are preferably configured to permit keyboard worksurface 6 to be shifted vertically between a sitting position of around 23 inches above the floor surface, and a standing position of approximately 42 inches above the floor surface.

Figure 6:
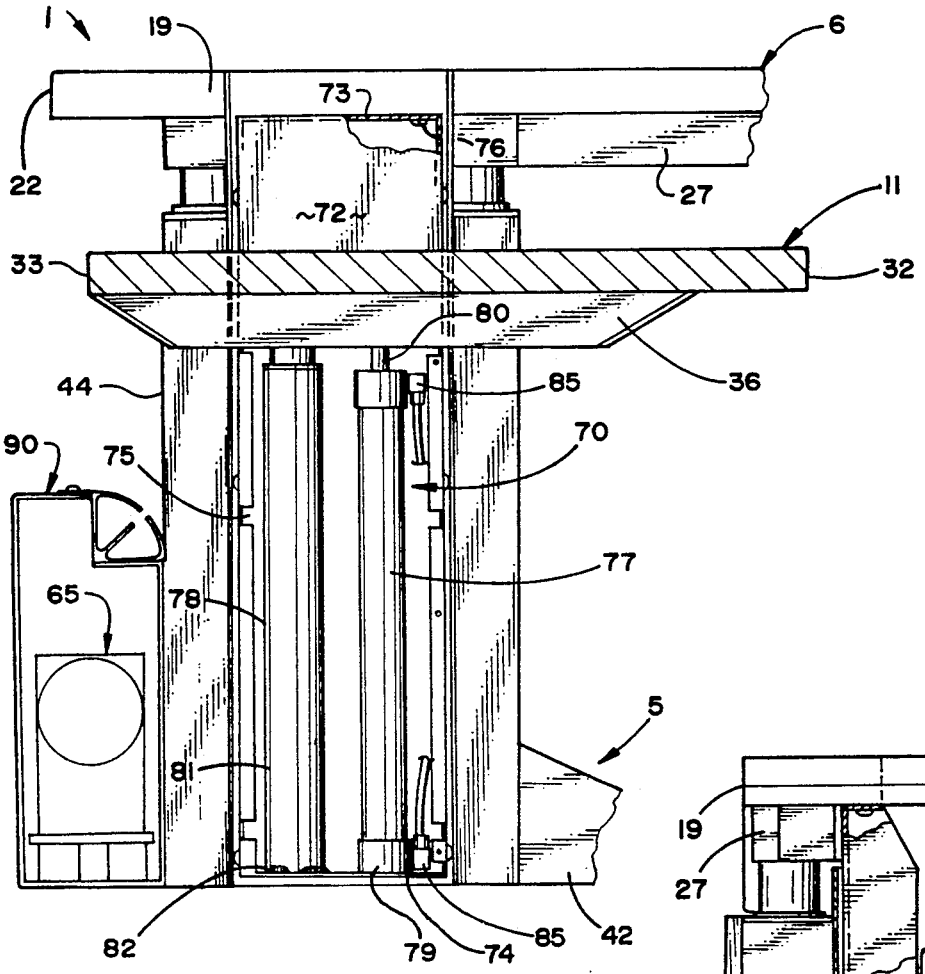
FIG. 6 is a fragmentary, vertical cross-sectional view of the dual worksurface support, particularly showing the connection between keyboard and display worksurfaces.
Figure 7:
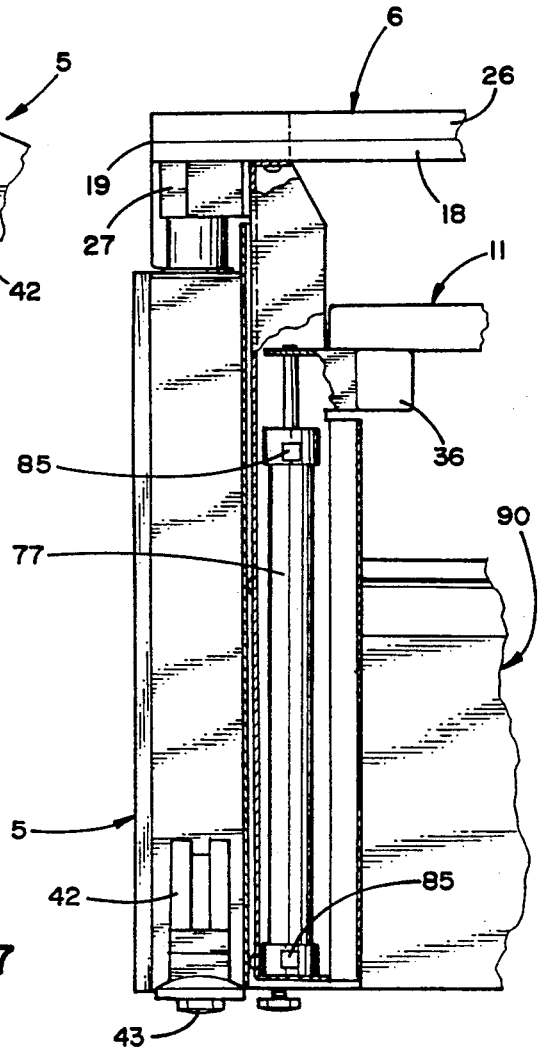
FIG. 7 is a fragmentary, front elevational view of the dual worksurface support, wherein portions thereof have been broken away to reveal the connection between the keyboard and display worksurfaces.

With reference to FIGS. 6 and 7, display worksurface 11 is attached to keyboard worksurface 6 by a pair of telescoping lift assemblies 70, which are positioned adjacent the opposite side edges 34 and 35 of display worksurface 11, such that display worksurface 11 travels vertically together with keyboard worksurface 6, and can also be vertically adjusted with respect to the height of keyboard worksurface 6 through the activation of lift assemblies 70. Lift assemblies 70 have a substantially identical construction, wherein each includes an elongate, vertically extending support bracket 72, having a generally L-shaped side elevational configuration, including a short, horizontally extending upper flange 73, a long, horizontally extending lower flange 74 and web 75 which extends vertically therebetween. The upper flange 73 of bracket 72 is attached by fasteners 76 to the lower surface of keyboard worksurface 6, adjacent the opposite interior edges 24 and 25 thereof. The web 75 of bracket 72 extends vertically downwardly along the interior side of an associated one of the leg assemblies 40 and 41, with the lower flange 74 extending inwardly to provide a ledge or support for a hydraulic cylinder 77, and a guide tube assembly 78, as discussed below.

Figure 5:
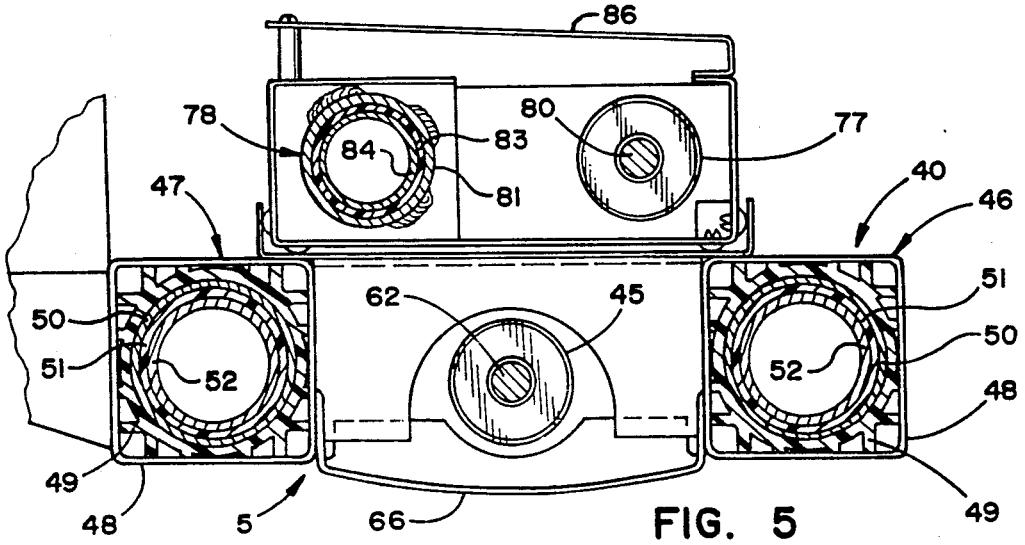
FIG. 5 is a horizontal cross-sectional view of a telescoping leg portion of the dual worksurface support.

As best shown in FIGS. 5, 6 and 7, the housing or lower end 79 of hydraulic cylinder 77 is attached to the lower flange 74 of bracket 72, and extends vertically upwardly therefrom. The rod or upper end 80 of hydraulic cylinder 77 is attached to the cantilever bracket 36 of display worksurface 11. Guide tube assembly 78 is positioned rearwardly of hydraulic cylinder 77, in fore-to-aft alignment with the same, and comprises an outer tube 81 having its lower end 82 connected with the lower flange 74 of bracket 72, and extending vertically upwardly therefrom. A sleeve shaped guide bearing 83 (FIG. 5) is mounted in the upper end of outer tube 81, and telescopingly receives therein an inner tube 84. The upper end of inner tube 84 is attached to the cantilever bracket 36 of display worksurface 11. Hydraulic lines 85 communicate pressurized hydraulic fluid between hydraulic pressure generator unit 65 and both hydraulic cylinders 77. The simultaneous extension and retraction of both hydraulic cylinders 77 vertically telescopes the tube 84 in both of the guide tube assemblies 78, so as to smoothly and evenly raise and lower display worksurface 11 with respect to keyboard worksurface 6. A removable cover plate 86 (FIG. 5) extends between adjacent outer tubes 48 to enclose the interior side of the associated leg assemblies 40 and 41, while permitting access to hydraulic cylinders 77 for repair and/or replacement. Preferably, display worksurface 11 can shift vertically from around 6 inches above keyboard worksurface 6 to approximately 5 inches below the same, so as to accommodate different tasks and users, particularly for those users wearing bifocal eyeglasses.

Figure 8:
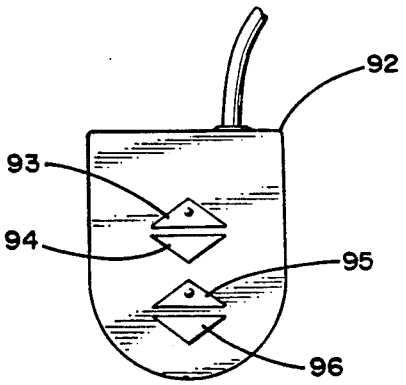
FIG. 8 is a top plan view of a controller for the dual worksurface support.

A hydraulic utility raceway 90 (FIGS. 1-3) extends uninterrupted between leg assemblies 40 and 41, along the rear, bottom portions thereof, and is shaped to house the hydraulic pressure generating unit 65 therein, which drives each of the hydraulic lift cylinders 45 and 77. In the illustrated example, the hydraulic pressure generating unit 65 (FIG. 4) mounted within hydraulic utility raceway 90 has a substantially conventional construction including an electric motor 91 which is operably connected to a hydraulic pump (not shown) that draws hydraulic fluid from a reservoir (not shown) through a filter (not shown). A pendant type controller 92 (FIG. 1) is operably connected with hydraulic pressure generator unit 65, so as to remotely actuate and deactuate the same. The illustrated controller 92 is adapted to be supported o the front surface 7 of keyboard worksurface 6, and includes four, two-position, push button switches 93-96 (FIG. 8) to independently raise and lower keyboard worksurface 6 and display worksurface 11.

In operation, dual worksurface 1 can be easily adjusted in the following fashion. A use positioned at the r forward edge 18 of keyboard worksurface 6, facing the same, grasps pendant controller 92 in such a fashion as to be able to manipulate switches 93 and 96. Switches 93-96 normally assume an extended deactivated or "off" position. Manipulation of switch 93 (FIG. 8) by depressing the same from the extended or raised "off" position causes both keyboard worksurface 6 and display worksurface 11 to simultaneously raise vertically, while depression of switch 94 from the raised "off" position cause both keyboard worksurface 6 and display worksurface 11 to simultaneously lower vertically. Manipulation of controller switch 95 by depressing the same from the extended "off" position causes display worksurface 11 to raise vertically with respect to keyboard worksurface 6, while depression of switch 96 from the raised "off" position causes display worksurface 11 to lower vertically with respect to keyboard worksurface 6. As previously noted, the vertical travel of keyboard worksurface 6 is preferably sufficient to permit the user to operate the keyboard 2 from either a sitting position or a standing position. Furthermore, the vertical travel of display worksurface 11 is preferably sufficient to position the display 4 either vertically below or above keyboard worksurface 6, so as to facilitate easy viewing, particularly for those users wearing bifocal eyeglasses.

Dual worksurface support 1 provides a stable and secure support for a variety of different types of equipment, and is particularly adapted for electronic data processing equipment, or other similar devices which have two or more separate pieces that are preferably independently adjustable. Dual worksurface support 1 provides independent vertical adjustment for both the keyboard worksurface 6 and the display worksurface 11 throughout a relatively wide range of travel, so as to greatly facilitate its use for a wide variety of different users and tasks.

In the foregoing description, it will be readily appreciated by those skilled in the art that modifications may be made to the invention without departing from the concepts disclosed herein. Such modifications are to be considered as included in the following claims, unless these claims by their language expessly state otherwise.

The embodiments of the invention in which an exclusive property or privilege is claimed are defined as follows.

1. A dual worksurface support for electronic data processing equipment having a keyboard and a display, said support comprising:

a freestanding pedestal;

a first worksurface having a generally U-shaped top plan configuration comprising a front surface shaped to support a keyboard thereon, and first and second side surface extending in a rearward direction from opposite sides of said front surface to define therebetween a central open area with a predetermined plane configuration; said first worksurface being supported on said pedestal, and being vertically adjustable between various heights;

a second worksurface having a plan shape similar to the predetermined plan configuration of the central open area of said first worksurface for close reception therein, and shaped to support a display thereon; said second worksurface being supported on said first worksurface, and being vertically adjustable to positions both above and below said first worksurface to accommodate various users and tasks.

2. A dual worksurface support as set forth in claim 1, including:

a first hydraulic cylinder connecting said first worksurface with said pedestal for vertical adjustment;

a second hydraulic cylinder connecting said second worksurface with said first worksurface for vertical adjustment; and a hydraulic controller operably connected with said first and second hydraulic cylinders to independently actuate said hydraulic cylinders.

3. A dual worksurface support as set forth in claim 1, wherein:

said first worksurface is vertically adjustable between a sitting position and a standing position.

4. A dual worksurface support as set forth in claim 3, including:

a first hydraulic cylinder connecting said first worksurface with said pedestal for vertical adjustment;

a second hydraulic cylinder connecting said second worksurface with said first worksurface for vertical adjustment; and a hydraulic controller operably connected with said first and second hydraulic cylinders to independently actuate said hydraulic cylinders.

5. A dual worksurface support as set forth in claim 4, including:

a first guide tube assembly positioned in a rearward direction from said first hydraulic cylinder, aligned with said first hydraulic cylinder in a fore-to-aft direction, and having a pair of vertically oriented telescoping tubular members connected with said pedestal and said first worksurface for ensuring smooth vertical movement of said first worksurface; and a second guide tube assembly positioned in a forward direction from said first hydraulic cylinder, aligned with said first hydraulic cylinder and said first guide tube assembly in a fore-to-aft direction, and having a pair of vertically oriented telescoping tubular members connected with said pedestal and said first worksurface for ensuring smooth vertical movement of said first worksurface, such that extension and retraction of said first hydraulic cylinder evenly raises and lowers said first worksurface.

6. A dual worksurface support as set forth in claim 5, including:

a third guide tube assembly positioned adjacent said second hydraulic cylinder, aligned with said second hydraulic cylinder in a fore-to-aft direction, and having a pair of vertically oriented telescoping tubular members connected with said first and second worksurfaces respectively for ensuring smooth vertical movement of said second worksurface with respect to said first worksurface.

7. A dual worksurface support as set forth in claim 6, wherein:

said first worksurface includes a beveled front edge positioned forwardly of said front surface for wrist support.

8. A dual worksurface support as set forth in claim 7, wherein:

said pedestal includes a pair of telescoping legs depending from opposite sides of said first worksurface, which are defined at least in part by said guide tube assemblies and said hydraulic cylinders.

9. A dual worksurface support as set forth in claim 8, including:

a hydraulic pressure generator unit for selectively activating said hydraulic cylinders; and an elongate utility raceway extending between said telescoping legs along lower portions thereof, and housing said hydraulic pressure generator unit therein.

10. A dual worksurface support as set forth in claim 9, including:

a pendant controller operably connected with said hydraulic pressure generator unit through a flexible conduit for convenient user manipulation from adjacent a front portion of said worksurface.

11. A dual worksurface support as set forth in claim 1, wherein:

said pedestal includes a pair of telescoping legs depending from opposite sides of said first worksurface, which include at least one hydraulic cylinder for vertically adjusting one of said first and second worksurfaces; and including a hydraulic pressure generator unit for selectively activating said hydraulic cylinder; and an elongate utility raceway extending between said telescoping legs along lower portions thereof, and housing said hydraulic pressure generator unit therein.

12. A dual worksurface support as set forth in claim 1, including:

a pendant controller for vertically adjusting said first and second worksurfaces.

13. A vertically adjustable support for electronic data processing equipment, comprising:

a worksurface shaped to support equipment thereon;

a freestanding support having an upper portion thereof connected with said worksurface, and a lower portion thereof adapted to be supported on a floor surface; and support having a pair of telescoping legs depending from opposite sides of said worksurface for vertically adjusting said worksurface above the floor surface;

each of said telescoping legs includes a longitudinally extensible hydraulic cylinder having opposite ends thereof connected with the upper and lower portions respectively of said support;

a hydraulic press generator unit operably connected with and selectively activating each said hydraulic cylinder;

an elongate utility raceway extending between said telescoping legs along lower portions thereof, and housing said hydraulic pressure generator unit therein; and a pendant controller operably connected with said hydraulic pressure generator unit through a flexible conduit for convenient user manipulation from adjacent a front portion of said worksurface.

14. A vertically adjustable support as set forth in claim 13, wherein:

said worksurface defines a first worksurface; and including a second worksurface supported for vertical adjustment with respect to said first worksurface.

15. A vertically adjustable support as set forth in claim 14, wherein:

said second worksurface is adjustable to positions both above and below said first-named worksurface.

16. A vertically adjustable support as set forth in claim 15, including;

at least one longitudinally extensible hydraulic cylinder having opposite ends thereof connected with said first worksurface and said second worksurface respectively, and operatively connected with said hydraulic pressure generator unit for activation by manipulation of said pendant controller.

17. A vertically adjustable support as set forth in claim 16, wherein:

said first worksurface has a generally U-shaped top plan configuration.

18. A vertically adjustable support as set forth in claim 17, wherein:

said first worksurface includes a front surface shaped to support a keyboard thereon, and a rearwardly extending central opening.

19. A vertically adjustable support as set forth in claim 18, wherein:

said second worksurface is shaped for close reception in the central opening of said first worksurface.

* * * * *

UNITED STATES PATENT AND TRADEMARK OFFICE

CERTIFICATE OF CORRECTION

PATENT NO. : 5,322,025

DATED : June 21, 1994

INVENTOR(S) : Patrick J. Sherman et al.

It is certified that error appears in the above-indentified patent and that said Letters Patent is hereby corrected as shown below:

Column 1, line 49;
Before "display" insert --a--.

Column 5, line 38;
Before "web" insert --a--.

Column 6, line 26;
"supported o" should be --supported on--.

Column 6, line 33;
Before "forward" delete --r--.

Column 7, line 19;
"surface" should be --surfaces--.

UNITED STATES PATENT AND TRADEMARK OFFICE

CERTIFICATE OF CORRECTION

PATENT NO. : 5,322,025

DATED : June 21, 1994

INVENTOR(S) : Patrick J. Sherman et al

It is certified that error appears in the above-indentified patent and that said Letters Patent is hereby corrected as shown below:

Column 9, line 1, claim 13, "and" should be --said --.

Column 9, line 9, claim 13, "press" should be --pressure --.

Signed and Sealed this

Thirty-first Day of January, 1995

*Attest:*

*Attesting Officer*

BRUCE LEHMAN

*Commissioner of Patents and Trademarks*